United States Patent [19]

Hovde

[11] Patent Number: 4,557,096

[45] Date of Patent: Dec. 10, 1985

[54] WALL BOARDINGS

[76] Inventor: Oskar Hovde, Kyvannsveien 34, N-7000 Trondheim, Norway

[21] Appl. No.: 477,172

[22] Filed: Mar. 18, 1983

[51] Int. Cl.[4] ..... E04C 1/10

[52] U.S. Cl. ..... 52/595; 52/212; 52/518; 52/313

[58] Field of Search ..... 52/314, 313, 311, 312, 52/212, 518, 595

[56] References Cited

FOREIGN PATENT DOCUMENTS

| | | | |
|---|---|---|---|
| 643704 | 5/1964 | France | 52/595 |
| 1569989 | 6/1969 | France | 52/595 |
| 159606 | 1/1933 | Switzerland | 52/595 |
| 163464 | 8/1933 | Switzerland | 52/595 |

*Primary Examiner*—Carl D. Friedman
*Assistant Examiner*—Naoko N. Slack

[57] ABSTRACT

Wall boardings having a series of wainscoting elements mounted in parallel and undercut at all edges. Strip-shaped lining mouldings are disposed both at the ends and between the wainscoting elements. The mouldings are overlapped along an adjacent undercut side edge of the wainscoting elements.

12 Claims, 6 Drawing Figures

WALL BOARDINGS

BACKGROUND OF THE INVENTION

The present invention relates to wall boardings having a series of parallel wainscoting elements.

Conventional wall panels place big demands on the skill of craftmanship. In addition, the mounting takes a long time resulting in lots of cut off ends and besides leaving behind dust and small bits of material which have to be cleared away.

Panel sheets are also known which can be secured with fastening clips and which are adapted in advance to a particular ceiling height. Such plates are, however, difficult to adapt to varying ceiling heights. Besides, the bordering with such plates continues to be labor-demanding and difficult to perform. The most significant disadvantage with conventional panel sheets is, however, that the finishing around doors and windows is difficult to carry out and awkward to get to go together visibly with the wall surfaces.

Ceiling facing is also known where sheets are fastened in a diamond pattern and where the joints are covered by borders which, if desired, can be undercut along the sides so that they engage over the sheet edges. The mounting of such borders involves, however, painstaking cutting into lengths and, if necessary, carving in addition.

The main object of the present invention is to create boardings for walls where the elements can be made ready in advance and employed at different ceiling heights without labor- and skill-demanding adaptation during mounting. The mounting ought to be simple and the finished boarding ought to have an attractive appearance, independent of the skill of the carpenter, to the person who has carried out the work.

It is also an objective to create boardings which do not leave behind specks of dust after mounting.

SUMMARY OF THE INVENTION

According to the present invention a wall boarding comprises a series of wainscoting elements mounted in parallel and undercut at all edges and strip-shaped lining mouldings disposed both at the ends and between said wainscoting elements, said mouldings being overlapped along an adjacent undercut side edge of said wainscoting elements.

The lining mouldings can have different breadths. It has been found convenient for a horizontally disposed cover strip to overlap at its lower edge a strip-shaped lining moulding along the upper edge of the latter. Another strip-shaped lining moulding can be overlapped along its under edge by the upper edge of this cover strip. Preferably, the cover strip is undercut on at least one side thereof so as to permit a variation in the degree of overlapping between the strip and an adjacent lining moulding. By varying the overlapping, an mm accurate edge accommodation can thereby be effected at ceiling, windows and doors. This can be done in a rational manner with relatively simple equipment. Good utilisation of the materials is possible so that in the fabrication process unreasonable play or cut off ends do not occur either.

The lining mouldings between the wainscoting elements are often plates with dimensions permitting wainscoting elements of reduced breadth to be used.

DESCRIPTION OF THE PREFERRED EMBODIMENTS

Figure 1:
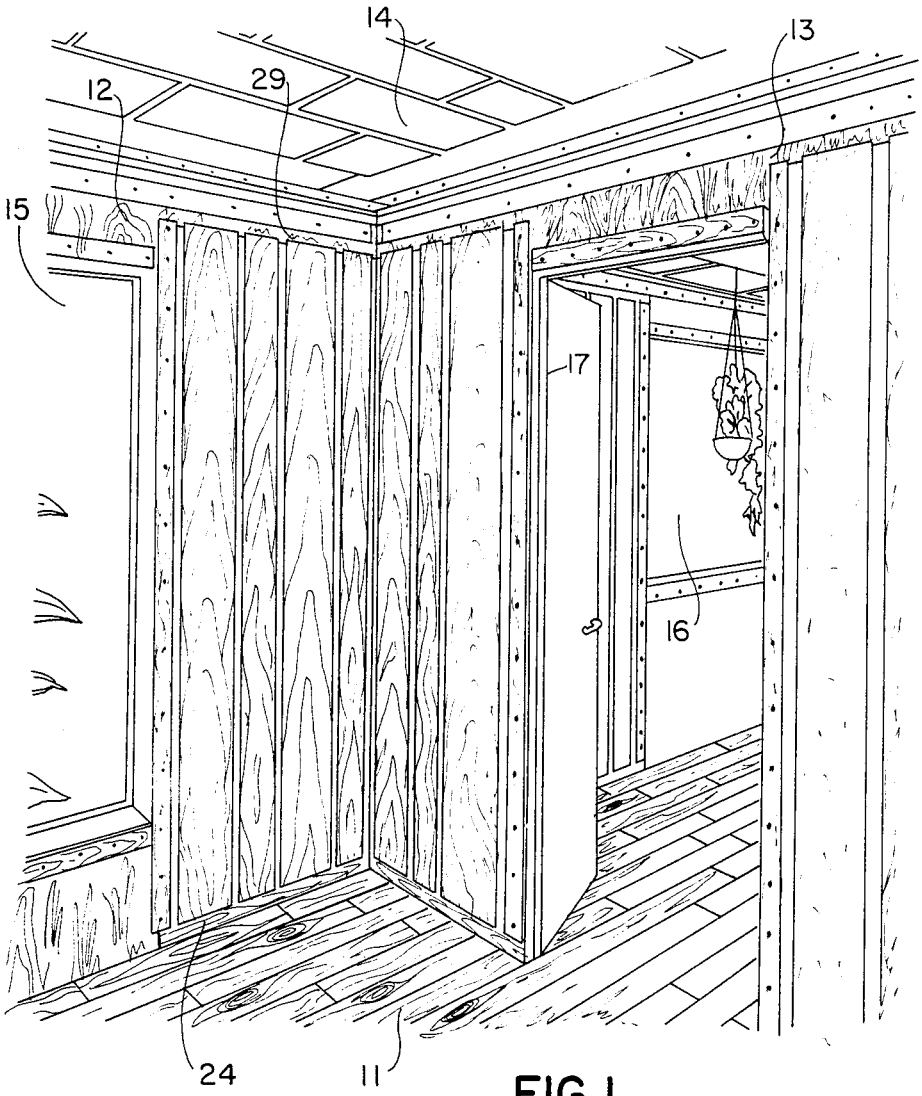
FIG. 1 is a perspective view of a corner of a room provided with a wall boarding.

The invention can best be understood by reference to the embodiments seen in FIGS. 1 through 6. I FIG. 1, there is shown a corner of a room with a floor 11, two walls 12 and 13 and panelled ceiling 14. The panelled ceiling can be designed independently of the walls but is preferably provided with a boarding as will be described below. In the wall 12, there is a window 15 and in the wall 13, a door opening 16 with a door 17.

A basic element is a wainscoting element 18 which can be designed and secured as disclosed in Norwegian Patent Application No. 810,513 with fastening clips on horizontal fastening laths (not shown). For example, fastening clips can be used with a plate-shaped main portion which, on each side, has a wing which stands at right angles out from the main portion and which at the end is folded into a grip claw. The breadth of the wainscoting or boarding elements can vary.

Figure 5:
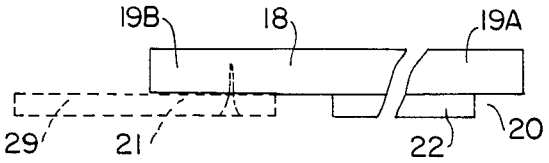
FIG. 5 is a schematic end view of a wainscoting element used in the wall boarding.

All edges of the wainscoting element 18 are drawn forwards to noses 19A,19B (see FIG. 5). In reality noses 19A,19B are formed due to an undercut 20,21 being milled out along both side edges and an undercut 22 at both end edges. The undercut 20 along one of the side edges and the undercut 22 along the end edges can have a dimension (breadth) in from the edge of about 10 mm while the undercut 21 along the other side edge has a significantly greater dimension, for example, 23 mm.

At the under edge of the wall boarding in FIG. 1, there is disposed a skirting board 24 of smooth edged, thin material which fits into the undercut 22 at the lower end edge of the wainscoting elements 18.

Figure 2:
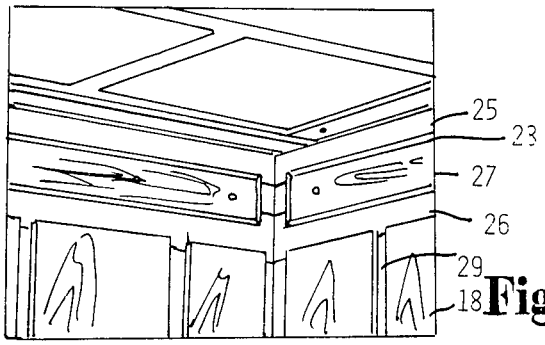
FIG. 2 is an enlarged perspective view of a section of the corner at the upper edge of the wall of FIG. 1.
Figure 6:
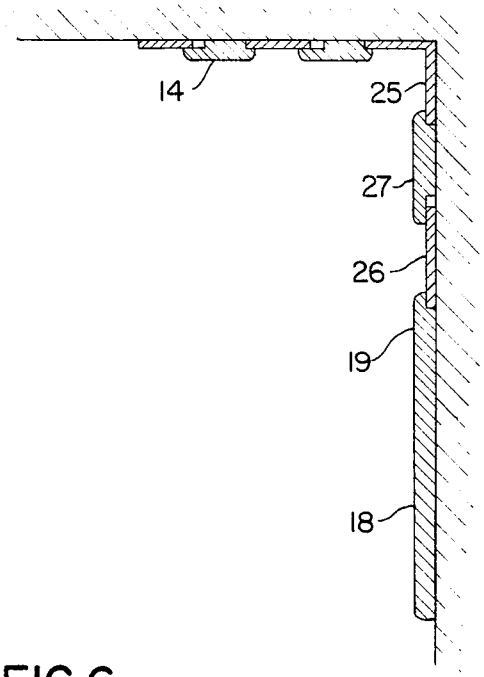
FIG. 6 is a vertical section through the upper part of the wall and adjacent part of the ceiling.

In FIGS. 2 and 6, there is illustrated how this boarding can be terminated at the upper edge of the wall. Here there are mounted two thin, smooth-edged borders called underlying or lining strips, a first 25 right up under the ceiling and the other 26 at the upper edge 19 of the wainscoting or boarding elements 18. These two lining strips 25 and 26 are connected to a cover strip or accommodating strip 27 with chamfered or profiled edges 28 and with undercutting along the side edges and the end edges which, in principle, correspond to undercuts on the wainscoting element 18. At the under edge, however, the undercut has such a large dimension, for example, 23 mm, that different overlapping can be obtained between the lining strip 25 and the strip 27.

The mounting of this boarding occurs on placing in position the skirting board 24 and the horizontal fastening strips (not shown) for the mounting clips. Thereafter, there is placed at a corner a lining strip or underlying panel 29. Thus the wainscoting elements 18 are placed in position further out from this corner. Between the individual wainscoting elements, there is fixed an underlying panel or a lining strip 29 in the form of a thin, smooth-edged border. This is screwed securely to the supporting wainscoting element 18.

In an alternative embodiment, the underlying panels or lining strips 29 can have a substantially larger breadth than shown in FIG. 2, while the wainscoting elements 18 can be narrower. In this instance, plates can be used as lining strips. After the wainscoting elements 18 are secured, the two lining strips 25 and 26 are located by nailing, the one thus entirely below the ceiling and the other below the undercut 22 along the upper end edges of the wainscoting elements. The nailing of the lining strips 25 and 26 can be done concealedly. Finally, cover strip 27 is put in position. It is appropriately secured with nails or screws. On cutting into lengths, the ends are used which are preferably profiled in a manner corresponding to the side edges.

With this system, the breadth of the wainscoting can be adapted accurately to the wall by using lining strips 29 or corresponding plates of different breadth between the wainscoting elements 18. It is appropriate to mount the lining strips 29 on the wainscoting elements in pairs, for example, by means of screws which are screwed in from the back side as indicated above. It will be understood that wainscoting elements can be used of varying breadth.

The boarding can be adapted to the height of the ceiling, partly by choosing different breadths for the lining strips 25 and 26 and partly due to the variation in the overlapping between the cover strips 27 and the lower lining strips. Otherwise, it is possible to make the wainscoting elements 18 of different standard lengths. In principle, the wainscoting elements can be substantially shorter than the height of the ceiling and two or more such wainscoting elements can be mounted over each other.

Figure 3:
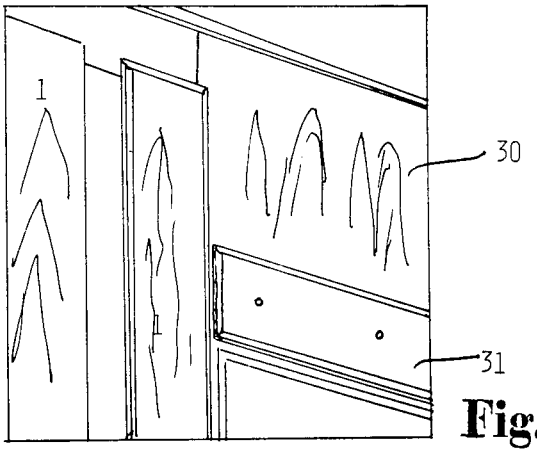
FIG. 3 is an enlarged perspective view of a section of the wall boarding at the termination at the upper edge of the door.

FIG. 3 illustrates how the boarding can be designed with a door 16. At the upper edge of the door, it is appropriate to place a sheet 30, for example, of plywood, which is cut so that it fits below the cover strip 27 and down below a corresponding strip 31 which is placed above the door frame. This reduces the demands for accurate fitting and accurate cutting of the sheet 30 because the overlapping of the cover strips 31 can be varied as required. At the ends, the sheet 30 can be allowed to go in under the last wainscoting element 18 up to the door on each side or a vertical cover strip 34 can be used. In this way, there is achieved the facing of the area above the door with ready made parts in the style of the remaining wall boarding without transitions being shown other than the joint between the end of the strip 26 and the end edge of the sheet 30. This reduces the demands for skill of craftmanship.

Figure 4:
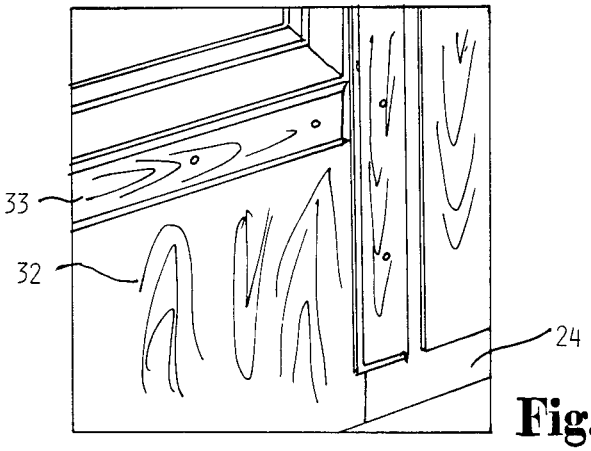
FIG. 4 is an enlarged perspective view of a section of the wall boarding at the corresponding termination at the under edge of a window.

FIG. 4 illustrates how one can correspondingly face the area below a window 15, a sheet 32 being used which is allowed to go entirely down to the floor. The upper edge of the sheet is covered by a cover strip 33 and which is secured to the window frame. The cover strip 33 is cross-cut if desired in the middle in order that the end will retain the shape they are given by the producer.

In the embodiment illustrated in the drawings, a room is shown where the dimensions are substantially standardised. However, the wall boardings of the present invention can also be used in rooms with ceiling heights above and below normal height. This can occur partly due to the use of wainscoting elements having larger or smaller lengths as mentioned above or due to the width and the overlapping on the strips being variable. With especially large ceiling heights it can be appropriate to mount hollow profile mouldings under the ceiling. This can in fact occur above the lining strip 25 in FIG. 2 and in that manner without further adapting the boarding.

In the corners, the cover strips 27 are allowed to terminate a short distance from each other. With this mitring becomes unnecessary, the ends of the cover strips 27 being able to be shaped in a manner corresponding to the sides. The openings in to the corner can then be filled out with sheets which correspond to the lining strips.

Wall boardings of the present invention can be modified in different ways. There can be utilised narrow or broad wainscoting elements or correspondingly broad or narrow lining strips. For example, plate elements can be employed as underlying panels or lining strips.

What is claimed is:

1. Wall boarding of predetermined external pattern for rooms with a ceiling, a door frame and a window frame and comprising:

(a) a series of wainscoting elements mounted vertically in parallel and undercut at all edges, (b) strip-shaped lining moldings for vertical and horizontal mounting, said vertical lining moldings being received at least between adjacent wainscoting elements in opposite undercut longitudinal side edges thereof while said horizontal lining moldings are received in undercut end edges of said wainscoting elements, (c) a first cover strip for mounting horizontally beneath said ceiling and having upper and lower opposite side edges which are undercut, said lower side edge receiving one of said horizontal lining moldings at its upper side while its lower side is received in undercut upper end edges of the wainscoting elements, (d) another strip-shaped molding received by the upper side edge of said first cover strip and extending up to the ceiling, (e) a second cover strip for mounting horizontally adjacent said door frame and undercut at at least its upper side edge, (f) a first sheet means arranged between said first and second cover strips so that its upper edge is received by an undercut lower side edge of said first cover strip while its lower edge is received by the undercut upper side edge of said second cover strip, (g) a third cover strip for mounting horizontally adjacent said window frame and undercut at at least its lower side edge, and (h) a second sheet means arranged between the floor and said third cover strip so that its upper edge is received by said undercut lower side edge of said third cover strip, each of said wainscoting elements having a longitudinal side edge undercut to a lateral depth substantially greater than that of its opposite undercut longitudinal side edge enabling vertical lining moldings of different breadths to be used while maintaining said predetermined external pattern of said wall boarding by regulating the extent to which said wainscoting element overlaps the breadth of its adjacent vertical lining molding.

2. Wall boarding according to claim 1, wherein a horizontal lining molding is in the form of a skirting board means arranged between the floor and the wainscoting elements, said skirting board means having its upper edge fitting into undercut lower end edges of said elements.

3. Wall boarding according to claim 1, wherein the vertical lining moldings between the wainscoting elements are secured to said elements.

4. Wall boarding according to claim 1, wherein the first sheet means has opposite vertical side edges received in undercut longitudinal side edges of wainscoting elements disposed one on each side of and adjacent to the door frame.

5. Wall boarding according to claim 1, wherein the second sheet means has opposite vertical side edges received in undercut longitudinal side edges of wainscoting elements disposed one on each side of and adjacent to the window frame.

6. Wall boarding according to claim 1, wherein a fourth cover strip is mounted vertically one on each side of and adjacent to the door frame, said cover strips being undercut to receive opposite vertical side edges of the first sheet means.

7. Wall boarding according to claim 6, wherein a fifth cover strip is mounted vertically one on each side of and adjacent to the window frame, said cover strips being undercut to receive opposite vertical side edges of the second sheet means.

8. Wall boarding according to claim 1, wherein said first cover strip has its lower side edge undercut to a lateral depth substantially greater than that of its opposite upper side edge enabling horizontal lining moldings of different breadths to be used, while maintaining said predetermined external pattern of said wall boarding, by regulating the extent to which said cover strip overlaps the breadth of said horizontal lining molding received at said lower side edge thereof.

9. Wall boarding according to claim 8, wherein said substantially greater lateral depth to which said lower side edge is undercut is about 23 mm.

10. Wall boarding according to claim 1, wherein said second cover strip has its upper side edge undercut to a lateral depth enabling first sheet means of different breadths to be used, while maintaining said predetermined external pattern of said wall boarding, by regulating the extent to which said second cover strip overlaps the breadth of said first sheet means received at said upper side edge thereof.

11. Wall boarding according to claim 1, wherein said third cover strip has its lower side edge undercut to a lateral depth enabling second sheet means of different breadths to be used, while maintaining said predetermined external pattern of said wall boarding, by regulating the extent to which said third cover strip overlaps the breadth of said second sheet means received at said lower side edge thereof.

12. Wall boarding according to claim 1, wherein said substantially greater lateral depth to which said longitudinal side edge is undercut is about 23 mm while the lateral depth of said opposite undercut longitudinal side edge is about 10 mm.

* * * * *